US011560202B2

(12) United States Patent
Parniske

(10) Patent No.: US 11,560,202 B2
(45) Date of Patent: Jan. 24, 2023

(54) POLE-LESS COVER

(71) Applicant: Taylor Made Group, LLC, Gloversville, NY (US)

(72) Inventor: Dennis J. Parniske, Parrish, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 611 days.

(21) Appl. No.: 16/596,974

(22) Filed: Oct. 9, 2019

(65) Prior Publication Data

US 2020/0108896 A1 Apr. 9, 2020

Related U.S. Application Data

(60) Provisional application No. 62/743,024, filed on Oct. 9, 2018.

(51) Int. Cl.
*B63B 17/02* (2006.01)

(52) U.S. Cl.
CPC ..... *B63B 17/02* (2013.01)

(58) Field of Classification Search
CPC ..... B63B 17/02; E04D 13/064; E04D 13/076; E04D 13/0767; A01G 9/1476; B60J 7/00; B60J 11/00; E04H 15/00; B60P 7/00
See application file for complete search history.

(56) References Cited

U.S. PATENT DOCUMENTS

| | | | | |
|---|---|---|---|---|
| 3,698,409 | A * | 10/1972 | Koontz | B63B 17/02 135/117 |
| 5,009,184 | A * | 4/1991 | Voidrich | B63B 17/02 114/361 |
| 5,228,408 | A | 7/1993 | Jannausch | |
| 5,228,409 | A | 7/1993 | Hodonsky | |
| 5,769,105 | A | 6/1998 | Margol et al. | |
| 6,102,059 | A | 8/2000 | Miller | |
| 6,167,658 | B1 | 1/2001 | Weiner | |
| 6,651,997 | B2 | 11/2003 | Higginson | |
| 6,725,871 | B1 | 4/2004 | Shearer et al. | |
| 7,347,159 | B1 | 3/2008 | Thompson | |
| 7,584,981 | B2 | 9/2009 | Vonderahe et al. | |
| 7,647,879 | B2 | 1/2010 | Del Valle Bravo et al. | |
| 8,656,967 | B2 | 2/2014 | Switzer | |
| 9,675,142 | B1 | 6/2017 | Hendricks | |
| 9,938,722 | B1 * | 4/2018 | Voress | E04D 13/076 |
| 10,336,406 | B2 | 7/2019 | Alexander | |
| 10,450,036 | B2 | 10/2019 | Killian | |
| 2013/0333304 | A1 * | 12/2013 | Smith | E04D 13/064 52/12 |
| 2014/0263001 | A1 * | 9/2014 | Higginbotham | E03F 1/00 210/162 |
| 2015/0184392 | A1 * | 7/2015 | Steinberg | F16M 13/02 52/12 |
| 2016/0258137 | A1 * | 9/2016 | Delost | E03B 3/03 |

(Continued)

*Primary Examiner* — Orlando Bousono
(74) *Attorney, Agent, or Firm* — Nixon & Vanderhye P.C.

(57) ABSTRACT

A pole-less cover assembly includes a cover member positionable over a structure and formed of an essentially impermeable material, and an integrated gutter system including a material section coupled with the cover member and formed of a porous material and a gutter disposed below the material section. Among other advantages, the pole-less cover assembly eliminates conventional tent poles required for existing boat covers, thereby reducing cost and facilitating installation.

20 Claims, 2 Drawing Sheets

(56) References Cited

U.S. PATENT DOCUMENTS

| | | | | |
|---|---|---|---|---|
| 2017/0152661 | A1* | 6/2017 | White | E04D 13/076 |
| 2017/0234030 | A1* | 8/2017 | Macias | E04H 15/58 135/20.1 |

* cited by examiner

POLE-LESS COVER

CROSS-REFERENCES TO RELATED APPLICATIONS

This application claims the benefit of U.S. Provisional Patent Application No. 62/743,024, filed Oct. 9, 2018, the entire content of which is herein incorporated by reference.

STATEMENT REGARDING FEDERALLY SPONSORED RESEARCH OR DEVELOPMENT (Not Applicable)

BACKGROUND

The invention relates to a cover and, more particularly, to a pole-less boat cover with an integrated gutter system.

Existing boat covers typically utilize tent poles or other risers to create a convex exterior surface so that water and/or other debris can run off the sides of the cover. The tent poles, however, can be burdensome to install and are not entirely secure or reliable.

SUMMARY

A boat cover according to the described embodiments may be installed without tent poles or any other supporting structure. The boat cover includes an integrated gutter system that allows water at the lowest cover point(s) to drain through the cover and into an integrated gutter positioned adjacent the cabin floor. By installing without tent poles, boat cover installation is easier and more secure.

In an exemplary embodiment, a pole-less cover assembly includes a cover member positionable over a structure and formed of an essentially impermeable material, and an integrated gutter system including a material section coupled with the cover member and formed of a porous material and a gutter disposed below the material section. The material section may include a mesh material. The material section may be coplanar with the cover member. The material section may be positioned at a low point based on a shape of the structure. In some embodiments, the material section extends along a length of the cover member and/or in a center of the cover member, whereas in other embodiments, the material section extends across a width of the cover member. The structure may include an exit port, and the gutter may be configured to carry water passed through the material section to the exit port. The gutter may be a U-shaped channel formed of a fabric or plastic material.

In some embodiments, the assembly includes a plurality of the integrated gutter systems. The structure may include a center console, and the pole-less cover assembly may include two of the integrated gutter systems, one each on opposite sides of the center console.

The cover member and the integrated gutter system may be configured to be secured over the structure without tent poles or other risers.

In another exemplary embodiment, a pole-less boat cover for covering a boat includes a cover member positionable over the perimeter and formed of an essentially impermeable material, and an integrated gutter system including a material section coupled with the cover member and formed of a porous material and a gutter disposed below the material section. The material section is positioned at the low point within the perimeter based on a shape of the structure, and the cover member and the integrated gutter system are configured to be secured over the perimeter without tent poles or other risers.

BRIEF DESCRIPTION OF THE DRAWINGS

These and other aspects and advantages will be described in detail with reference to the accompanying drawings, in which.

DETAILED DESCRIPTION

Figure 1:
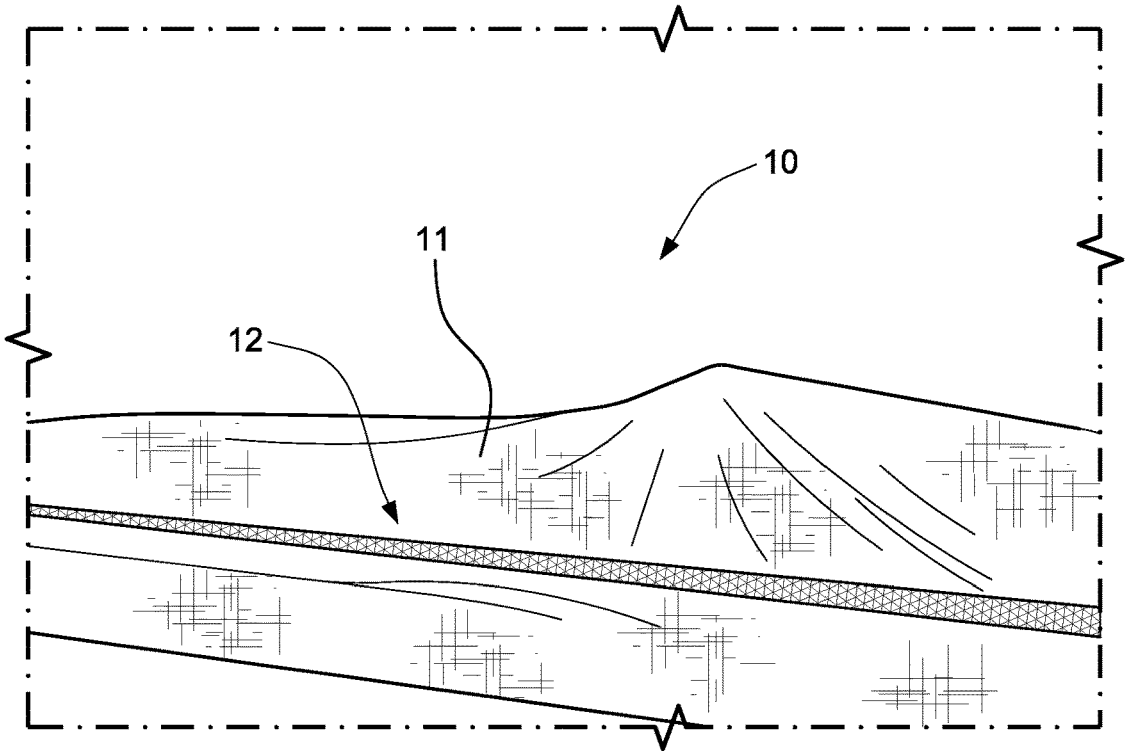
FIG. 1 is a perspective view of the pole-less cover installed on a boat.
Figure 2:
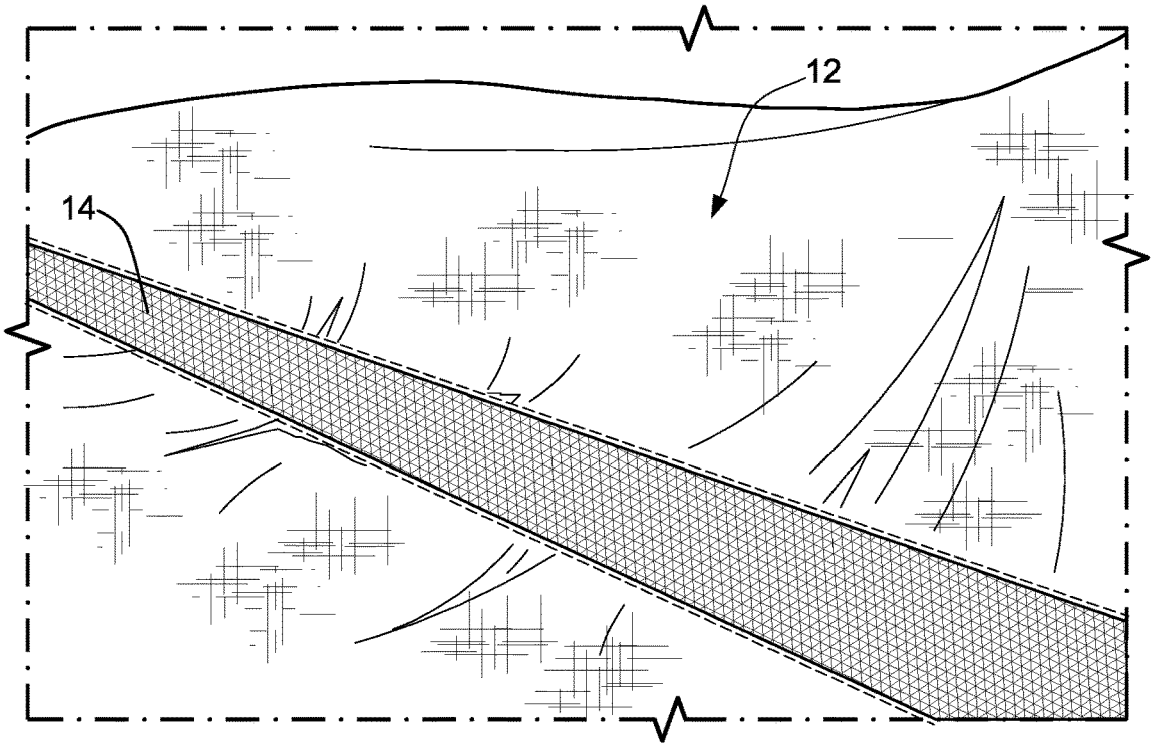
FIG. 2 is a close-up view showing the porous material section of the cover.
Figure 3:
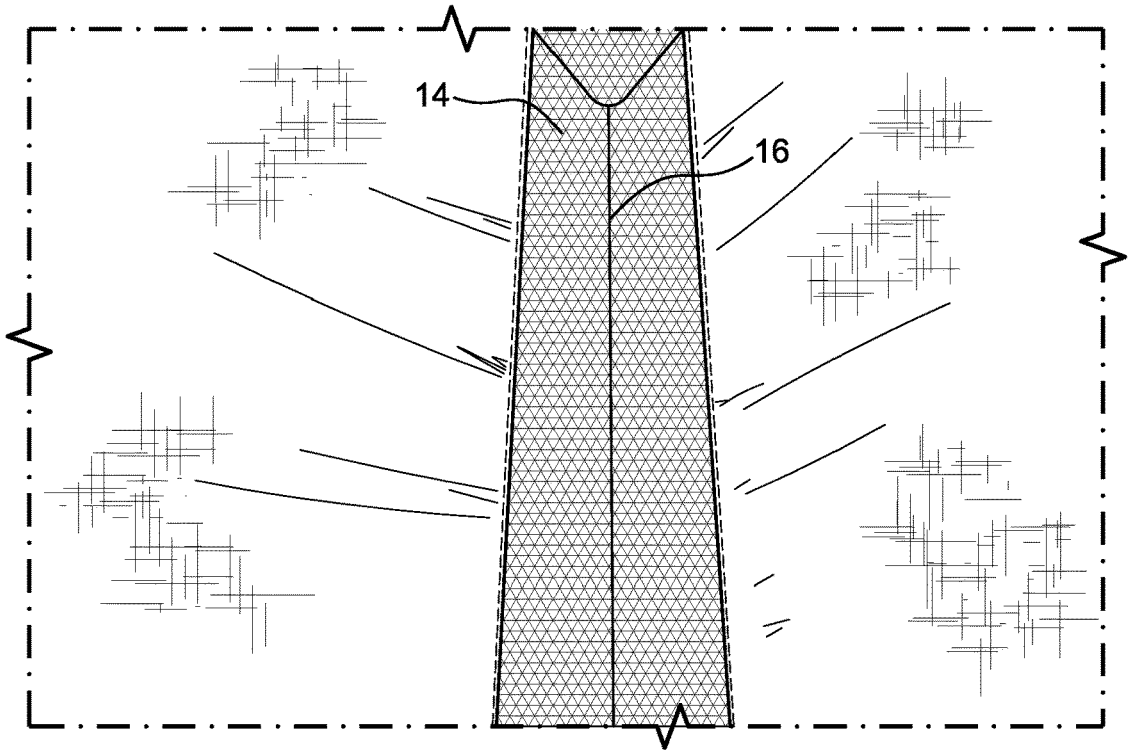
FIG. 3 shows the porous material section and the integrated gutter disposed below the material section.

With reference to FIGS. 1 and 2, a pole-less cover assembly 10 includes a cover member 11 positionable over a structure such as a boat and formed of an essentially impermeable material. An exemplary material is polyester fabric or the like.

An integrated gutter system 12 includes a material section 14 essentially coplanar with the cover member 11 and formed of a porous material and a gutter 16 disposed below the material section 14. The gutter 16 is oriented to direct water flowing through the material section 14 to an exit at either the forward or aft end of the boat or to an exit at port or starboard sides of the boat.

The integrated gutter system 12 is positioned adjacent one or more low points of the cover assembly when installed on the structure. The low point or points of the cover assembly can be determined based on a shape of the structure (e.g., boat) on which the cover assembly is to be installed.

In some embodiments, the material section 14 is a mesh material. The material section 14 may extend lengthwise across the length of the cover member 11 or width wise across a width of the cover member 11. The integrated gutter system may be disposed in a center of the cover member. The material section 14 allows water that is directed to the lowest cover point(s) to drain through the cover and into the integrated gutter 16 positioned adjacent the cabin floor.

Figure 4:
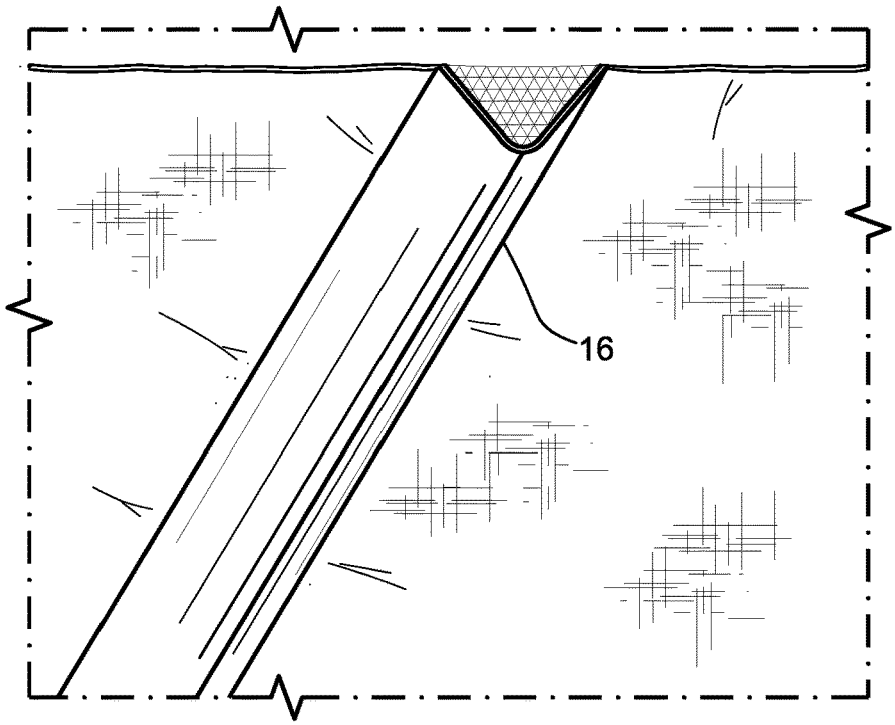
FIG. 4 is an end view of the gutter disposed below the material section.

With reference to FIG. 4, the integrated gutter 16 may be in the form of a U-shaped channel or the like formed of a fabric or plastic material. In some embodiments, the structure includes an exit port, and the gutter 16 is configured to carry water passed through the material section 14 to the exit port.

The cover 10 may include multiple integrated gutter systems 12, wherever a low point is effected when the cover is installed without poles. For example, the boat cover 10 may include two integrated gutter systems 12 on opposite sides of a boat console or the like. Of course, with some boat constructions, only a single integrated gutter system may be required.

With the structure of the described embodiments, conventional tent poles required for existing boat covers are eliminated, thereby facilitating installation. Additionally, boat operators need no longer be concerned with tent poles that fall out or shift while trailering. The boat cover is easily trailerable, fitting tighter to the boat with less material, and thereby with less wind resistance. Puddling of water in typical pocket areas is avoided. Without the tent poles, the cover can be installed in minutes, for example, with a clip-on construction (using, for example, the canvas clips described in pending U.S. application Ser. No. 16/049,162, the contents of which are hereby incorporated by reference).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A pole-less cover assembly comprising:

a pole-less cover member positionable over a structure and formed of a fabric material through which water is only partly passable or is impermeable; and an integrated gutter system including a material section coupled with the pole-less cover member and formed of a porous material and a gutter disposed below the material section.

2. A pole-less cover assembly according to claim 1, wherein the material section comprises a mesh material.

3. A pole-less cover assembly according to claim 1, wherein the material section is coplanar with the pole-less cover member.

4. A pole-less cover assembly according to claim 1, wherein the structure is shaped such that with the pole-less cover member positioned over the structure, there is a low point where water would collect, and wherein the material section is positioned at the low point based on the shape of the structure.

5. A pole-less cover assembly according to claim 1, wherein the material section extends along a length of the pole-less cover member.

6. A pole-less cover assembly according to claim 1, wherein the material section extends across a width of the pole-less cover member.

7. A pole-less cover assembly according to claim 1, wherein the structure includes an exit port, and wherein the gutter is configured to carry water passed through the material section to the exit port.

8. A pole-less cover assembly according to claim 1, wherein the gutter comprises a U-shaped channel formed of a fabric or plastic material.

9. A pole-less cover assembly according to claim 1, comprising a plurality of the integrated gutter systems, wherein the structure is shaped such that with the pole-less cover member positioned over the structure, there are a plurality of low points where water would collect, and wherein the material sections are positioned at the low points.

10. A pole-less cover assembly according to claim 9, wherein the structure includes a center console, the pole-less cover assembly comprising two of the integrated gutter systems, one each on opposite sides of the center console.

11. A pole-less cover assembly according to claim 1, wherein the integrated gutter system is disposed in a center of the pole-less cover member and extends along a length of the pole-less cover member.

12. A pole-less cover assembly according to claim 1, wherein the structure is a boat, wherein the pole-less cover assembly defines a boat cover, and wherein the pole-less cover member and the integrated gutter system are configured to be secured over the boat without tent poles or other risers.

13. A pole-less cover assembly according to claim 1, wherein the pole-less cover member and the integrated gutter system are configured to be secured over the structure without tent poles or other risers.

14. A pole-less boat cover for covering a boat including a perimeter and at least one low point within the perimeter, the pole-less boat cover comprising:

a pole-less cover member positionable over the perimeter and formed of a fabric material through which water is only partly passable or is impermeable; and an integrated gutter system including a material section coupled with the pole-less cover member and formed of a porous material and a gutter disposed below the material section, wherein the material section is positioned at a low point within the perimeter based on a shape of the structure, and wherein the pole-less cover member and the integrated gutter system are configured to be secured over the perimeter without tent poles or other risers.

15. A pole-less cover assembly according to claim 14, wherein the material section comprises a mesh material.

16. A pole-less cover assembly according to claim 14, wherein the material section is coplanar with the pole-less cover member.

17. A pole-less cover assembly according to claim 14, wherein the material section extends along a length of the pole-less cover member.

18. A pole-less cover assembly according to claim 14, wherein the material section extends across a width of the pole-less cover member.

19. A pole-less cover assembly according to claim 14, wherein the structure includes an exit port, and wherein the gutter is configured to carry water passed through the material section to the exit port.

20. A pole-less cover assembly according to claim 14, wherein the gutter comprises a U-shaped channel formed of a fabric or plastic material.

* * * * *